US010144109B2

(12) United States Patent
Tsai et al.

(10) Patent No.: US 10,144,109 B2
(45) Date of Patent: Dec. 4, 2018

(54) POLISHER, POLISHING TOOL, AND POLISHING METHOD

(71) Applicant: TAIWAN SEMICONDUCTOR MANUFACTURING CO., LTD., Hsinchu (TW)

(72) Inventors: Teng-Chun Tsai, Hsinchu (TW); Shen-Nan Lee, Hsinchu County (TW); Yung-Cheng Lu, Hsinchu (TW); Chia-Chiung Lo, Taipei (TW); Shwang-Ming Jeng, Hsinchu (TW); Yee-Chia Yeo, Hsinchu (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 307 days.

(21) Appl. No.: 14/985,173

(22) Filed: Dec. 30, 2015

(65) Prior Publication Data

US 2017/0190017 A1 Jul. 6, 2017

(51) Int. Cl.
*B24B 7/22* (2006.01)
*B24B 37/20* (2012.01)

(52) U.S. Cl.
CPC ..... *B24B 37/20* (2013.01)

(58) Field of Classification Search
CPC ..... B24B 7/22
USPC ..... 451/41, 168, 173, 59, 63
See application file for complete search history.

(56) References Cited

U.S. PATENT DOCUMENTS 5,938,504 A * 8/1999 Talieh ..... B24B 21/004 451/11
6,547,651 B1 * 4/2003 Boyd ..... B24B 37/20 451/285
6,705,922 B1 * 3/2004 Inbe ..... B24B 37/042 451/41

* cited by examiner

*Primary Examiner* — Robert Rose
(74) *Attorney, Agent, or Firm* — Maschoff Brennan

(57) ABSTRACT

A polisher includes a wafer carrier, a polishing head, a movement mechanism, and a rotation mechanism. The wafer carrier has a supporting surface. The supporting surface is configured to carry a wafer thereon. The polishing head is present above the wafer carrier. The polishing head has a polishing surface. The polishing surface of the polishing head is smaller than the supporting surface of the wafer carrier. The movement mechanism is configured to move the polishing head relative to the wafer carrier. The rotation mechanism is configured to rotate the polishing head relative to the wafer carrier.

20 Claims, 9 Drawing Sheets

POLISHER, POLISHING TOOL, AND POLISHING METHOD

BACKGROUND

CMP (Chemical Mechanical Polishing) is a process of smoothing surfaces with the combination of chemical and mechanical forces. It can be thought of as a hybrid of chemical etching and free abrasive polishing. The process uses an abrasive and corrosive chemical slurry (commonly a colloid) in conjunction with a polishing pad and retaining ring, typically of a greater diameter than the wafer. The pad and wafer are pressed together by a dynamic polishing head and held in place by a plastic retaining ring. The dynamic polishing head is rotated with different axes of rotation (i.e., not concentric). This removes material and tends to even out any irregular topography, making the wafer flat or planar. This may be necessary to set up the wafer for the formation of additional circuit elements. For example, CMP can bring the entire surface within the depth of field of a photolithography system, or selectively remove material based on its position.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
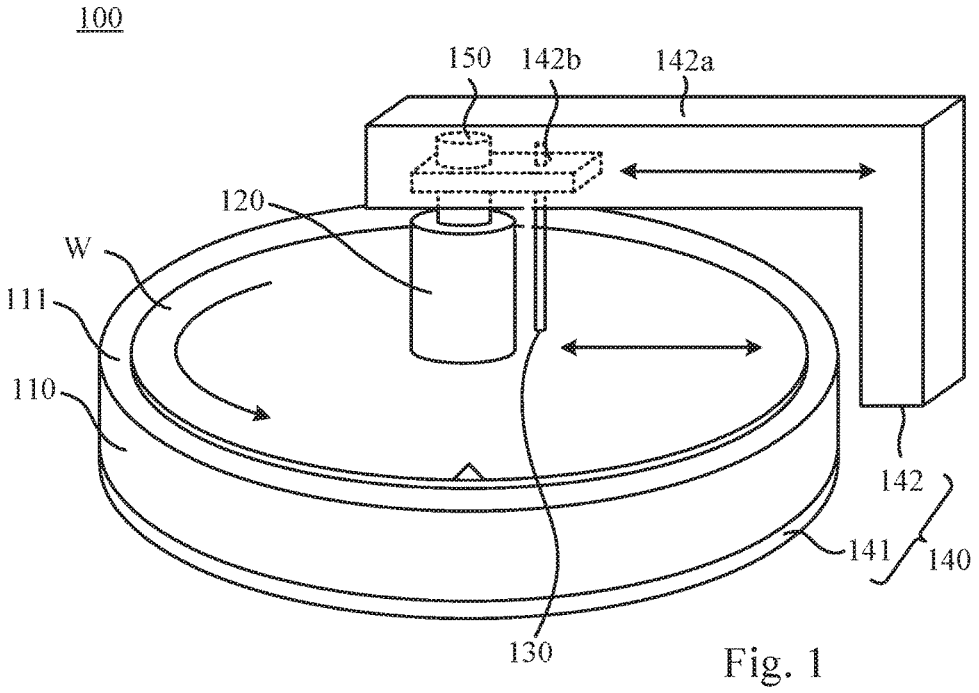
FIG. 1 is a side view of a die size polisher configured to polish a wafer according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
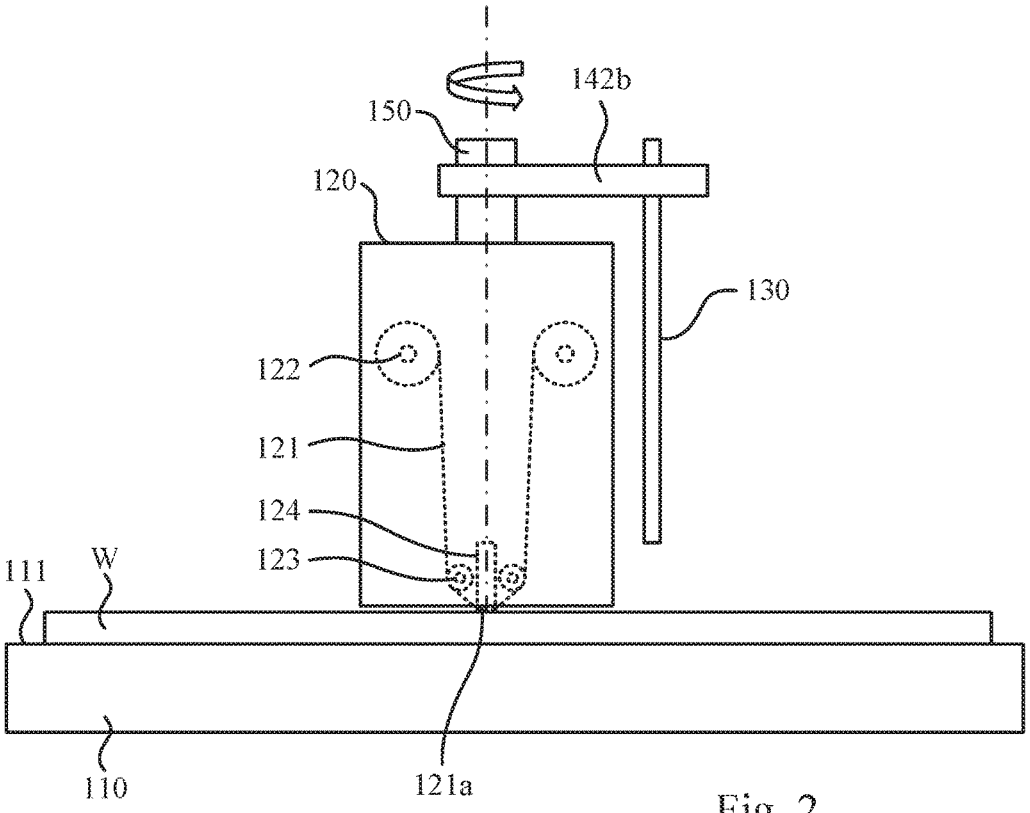
FIG. 2 is a side view of some components of the die size polisher in FIG. 1 according to some embodiments of the present disclosure.

Reference is made to FIGS. 1 and 2. FIG. 1 is a side view of a die size polisher 100 configured to polish a wafer according to some embodiments of the present disclosure. FIG. 2 is a side view of some components of the die size polisher 100 in FIG. 1 according to some embodiments of the present disclosure. The die size polisher 100 includes a wafer carrier 110, a polishing head 120, a movement mechanism 140, and a rotation mechanism 150. The wafer carrier 110 has a supporting surface 111. The supporting surface 111 is configured to carry a wafer W thereon. The polishing head 120 is present above the wafer carrier 110. The polishing head 120 has a polishing surface 121*a*, in which the polishing surface 121*a* of the polishing head 120 is smaller than the supporting surface 111 of the wafer carrier 110. The movement mechanism 140 is configured to move the polishing head 120 relative to the wafer carrier 110. The rotation mechanism 150 is configured to rotate the polishing head 120 relative to the wafer carrier 110. As used therein, the term "die size polisher" refers to a polisher that has a polishing surface whose area is substantially the same as that of a die on the wafer. For example, the polishing surface 121*a* of the polishing head 120 of the die size polisher 100 has an area substantially the same as that of a die on the wafer W. The detailed structures of the polishing head 120 are discussed below.

As shown in FIG. 1, the movement mechanism 140 includes a rotation module 141 and a linear movement module 142. The rotation module 141 is disposed under the wafer carrier 110 and is configured to rotate the wafer carrier 110 relative to the polishing head 120. The linear movement module 142 includes a rail 142*a* and a moving block 142*b*. The rotation mechanism 150 is rotatably disposed on the moving block 142*b*. The linear movement module 142 is configured to linearly move the moving block 142*b* along the rail 142*a*, so as to linearly move the polishing head 120 relative to the wafer carrier 110. In some embodiments, the linear movement module 142 of the movement mechanism 140 is configured to linearly move the polishing head 120 between the peripheral edge and the center of the wafer W. Under the structural configuration, the movement mechanism 140 can move the polishing head 120 to polish any part on the wafer W with the polishing surface 121*a* by using the rotation module 141 and the linear movement module 142. By moving the polishing head 120 at a specific radius position relative to the center of the wafer W between the peripheral edge and the center of the wafer W with a specific dwell time, a specific symmetric removal amount can be performed at a circular surface area (corresponding to the specific radius position) of the wafer W.

As shown in FIG. 2, the polishing head 120 includes a polishing pad tape 121, a tape tension pulley assembly 122, a tape guiding pulley assembly 123, and a pushing head 124. The tape tension pulley assembly 122 is configured to carry the polishing pad tape 121. Specifically, the tape tension pulley assembly 122 includes two tape tension pulleys, and two ends of the polishing pad tape 121 are respectively coupled with the tape tension pulleys, so that the polishing pad tape 121 can be transferred from one of the tape tension pulleys to another of the tape tension pulleys. The tape guiding pulley assembly 123 is configured to guide the polishing pad tape 121 to the pushing head 124. Specifically, the tape guiding pulley assembly 123 includes two tape guiding pulleys. The tape guiding pulleys are respectively located at opposite sides of the pushing head 124, so as to smoothly transfer the polishing pad tape 121 to the pushing head 124. The pushing head 124 is configured to push at least a part of the polishing pad tape 121 against the wafer W, in which the part of the polishing pad tape 121 pushing against the wafer W is the polishing surface 121*a* of the polishing head 120. In some embodiments, after the wafer W is polished, the polishing pad tape 121 is moved forward to present a new polishing surface 121*a* for polishing another wafer W, so as to keep a stable removal rate.

In some embodiments, the polishing pad tape 121 may be a polishing tape with or without at least one abrasive thereon. The polishing tape can be made of PU (Polyurethane) or PET (polyethylene terephthalate). The abrasive can be made of silica, alumina, ceria, SiC, or diamond. The polishing pad tape 121 has a width in a range from about 1 mm to about 100 mm.

In addition, the die size polisher 100 further includes a polishing liquid dispenser 130. The polishing liquid dispenser 130 is connected to the moving block 142*b* and is configured to dispense polishing liquid onto the wafer W. In some embodiments, the polishing liquid may be a chemical, slurry, or DIW (de-ionized water), but the disclosure is not limited in this regard. Silica, alumina, or ceria based slurry can be used as the polishing liquid when the polishing pad tape 121 does not has the abrasive thereon.

Figure 3:
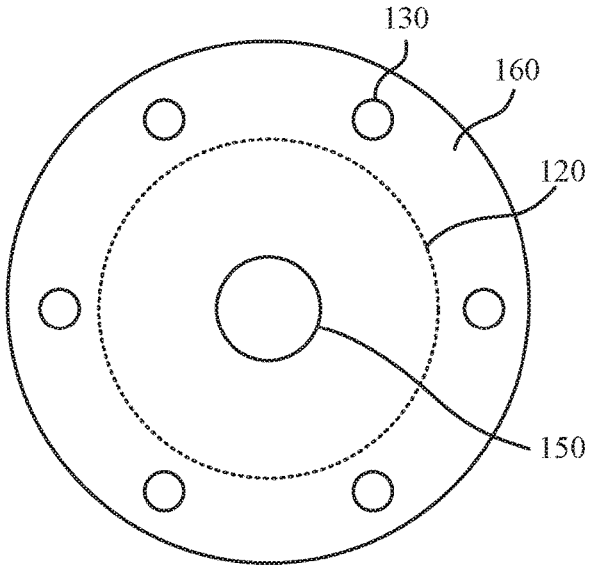
FIG. 3 is a top view of some components of the die size polisher according to some other embodiments of the present disclosure.

Reference is made to FIG. 3. FIG. 3 is a top view of some components of the die size polisher 100 according to some other embodiments of the present disclosure. As shown in FIG. 3, a plurality of the polishing liquid dispensers 130 are connected to the moving block 142*b* and present adjacent to the polishing head 120. For simplicity, only one polishing liquid dispenser 130 is labeled. Specifically, in some embodiments, the polishing liquid dispensers 130 equidistantly surround the polishing head 120, but the disclosure is not limited in this regard. With the plurality of the polishing liquid dispensers 130 to apply polishing liquid, the polishing head 120 can polish the wafer W with sufficient polishing liquid.

Figure 4:
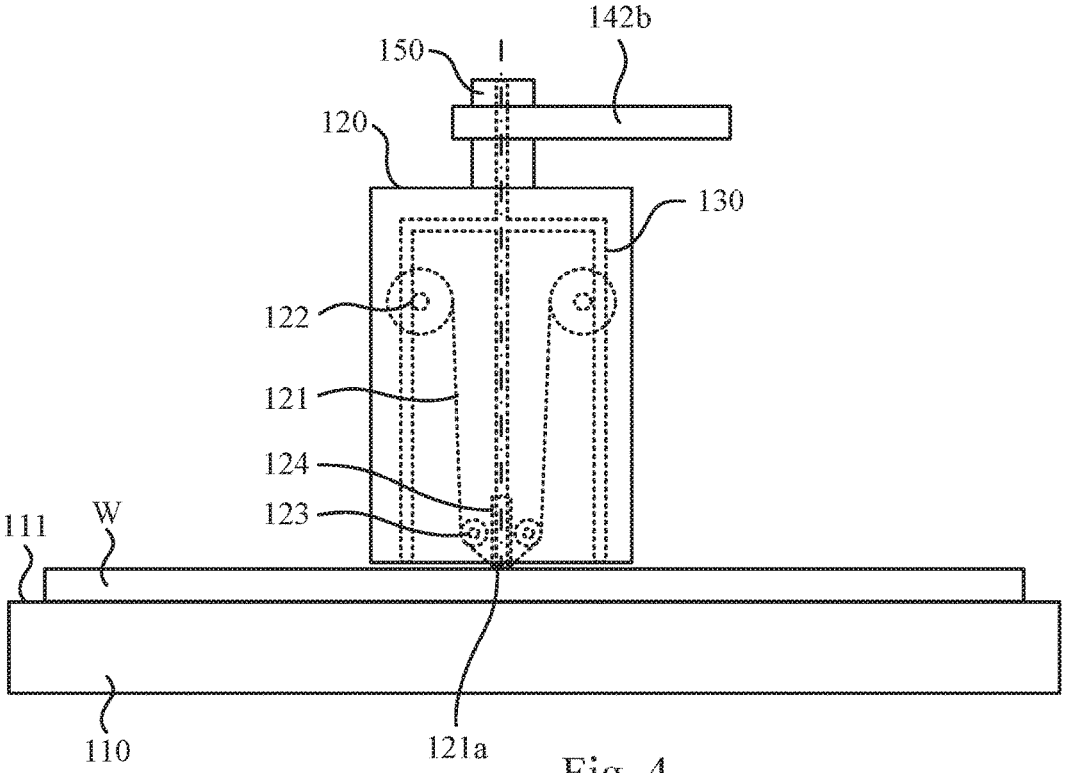
FIG. 4 is a side view of some components of the die size polisher in FIG. 1 according to some embodiments of the present disclosure.
Figure 5:
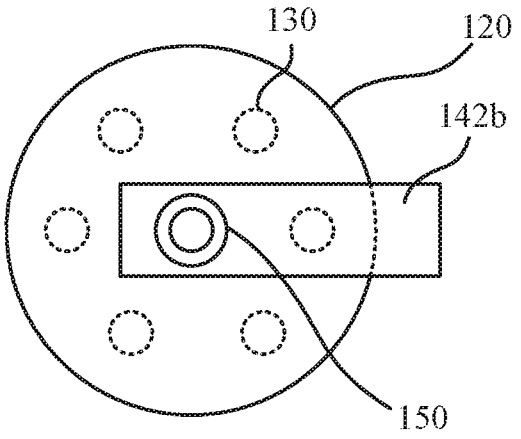
FIG. 5 is a top view of some components of the die size polisher in FIG. 4 according to some embodiments of the present disclosure.

Reference is made to FIGS. 4 and 5. FIG. 4 is a side view of some components of the die size polisher 100 in FIG. 1 according to some embodiments of the present disclosure. FIG. 5 is a top view of some components of the die size polisher 100 in FIG. 4 according to some embodiments of the present disclosure. As shown in FIGS. 4 and 5, the polishing liquid dispenser 130 is present on the polishing head 120. In some embodiments, the polishing liquid dispenser 130 is embedded in the polishing head 120 and is in fluid communication from the moving block 142*b* and the rotation mechanism 150 to the bottom of the polishing head 120. Specifically, in some embodiments, the polishing liquid dispenser 130 includes a plurality of liquid channels communicated with each other. With the polishing liquid dispenser 130 including the plurality of liquid channels to apply polishing liquid, the polishing head 120 can polish the wafer W with sufficient polishing liquid. Moreover, with the polishing liquid dispenser 130 embedded in the polishing head 120, the polishing head 120 can rotate with the polishing liquid dispenser 130, so that the polishing liquid can be uniformly spread onto the wafer W when the polishing head 120 polishes the wafer W.

Figure 6:
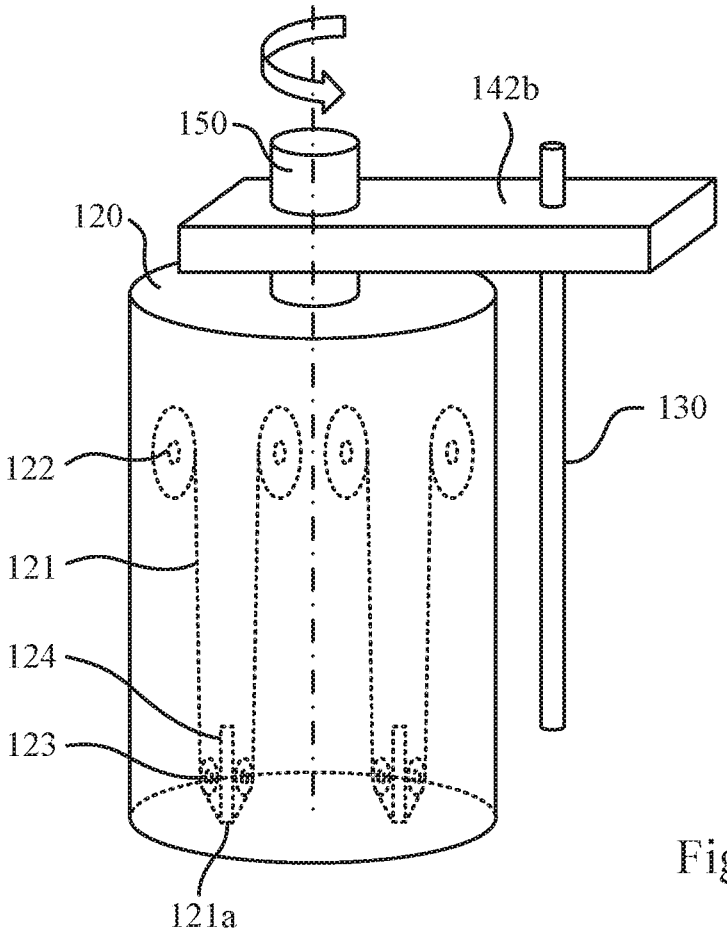
FIG. 6 is a perspective view of some components of a die size polisher according to some embodiments of the present disclosure.

Reference is made to FIG. 6. FIG. 6 is a perspective view of some components of a die size polisher 100 according to some embodiments of the present disclosure. As shown in FIG. 6, the polishing head 120 includes two polishing pad tapes 121 121, two tape tension pulley assemblies 122, two tape guiding pulley assemblies 123, and two pushing heads 124. For simplicity, only one polishing pad tape 121, one tape tension pulley assembly 122, one tape guiding pulley assembly 123, and one pushing head 124 are labeled. Each of the polishing pad tape 121 may be with or without abrasive. Each of the tape tension pulley assemblies 122 is configured to carry the corresponding polishing pad tape 121. Specifically, each of the tape tension pulley assemblies 122 includes two tape tension pulleys, and two ends of the corresponding polishing pad tape 121 are respectively coupled with the tape tension pulleys, so that the corresponding polishing pad tape 121 can be transferred from one of the tape tension pulleys to another of the tape tension pulleys. That is, the used polishing pad tape 121 is recycled after polished. Each of the tape tension pulley assemblies 122 is configured to guide the corresponding polishing pad tape 121 to the corresponding pushing head 124. Specifically, each of the tape guiding pulley assemblies 123 includes two tape guiding pulleys. The tape guiding pulleys are respectively located at opposite sides of the corresponding pushing head 124, so as to smoothly transfer the corresponding polishing pad tape 121 to the corresponding pushing head 124. Each of the pushing heads 124 is configured to push at least a part of the corresponding polishing pad tape 121 against the wafer W. By using the pluralities of the polishing pad tapes 121 121, the tape tension pulley assemblies 122, the tape guiding pulley assemblies 123, and the pushing heads 124 in the polishing head 120, the removal rate of the polishing head 120 can be theoretically increased twice. However, the numbers of the polishing pad tapes 121

121, the tape tension pulley assemblies 122, the tape guiding pulley assemblies 123, and the pushing heads 124 used in the polishing head 120 are not limited in this regard.

Figure 7:
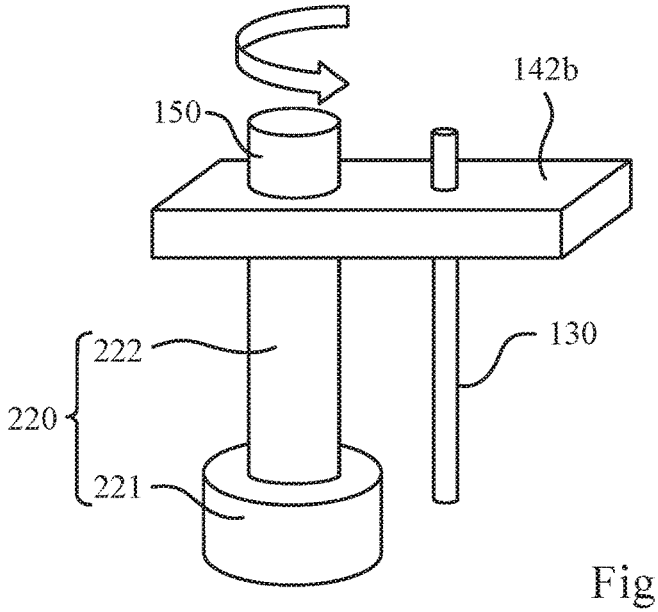
FIG. 7 is a perspective view of some components of a die size polisher according to some embodiments of the present disclosure.

Reference is made to FIG. 7. FIG. 7 is a perspective view of some components of a die size polisher 100 according to some embodiments of the present disclosure. As shown in FIG. 7, the polishing head 220 includes a die size polishing pad 221 and a carrier head 222. The carrier head 222 is operatively connected to the rotation mechanism 150 and the die size polishing pad 221, so that the rotation mechanism 150 can rotate the die size polishing pad 221 relative to the wafer carrier 110 and thus polish the wafer W, in which the bottom surface of the die size polishing pad 221 is exactly the polishing surface of the polishing head 220. In addition, the polishing liquid dispenser 130 is connected to the moving block 142*b*, and is configured to dispense polishing liquid onto the wafer W. In some embodiments, the polishing liquid may be a chemical, slurry, or DIW (de-ionized water), but the disclosure is not limited in this regard. In some embodiments, a plurality of the polishing liquid dispensers 130 are connected to the moving block 142*b* and present adjacent to the polishing head 220 (as FIG. 3 shows). With the plurality of the polishing liquid dispensers 130 to apply polishing liquid, the polishing head 220 can polish the wafer W with sufficient polishing liquid. In some embodiments, the polishing liquid dispenser 130 is embedded in the polishing head 220 and is in fluid communication from the moving block 142*b* and the rotation mechanism 150 to the bottom of the polishing head 220 (as FIG. 5 shows). In some embodiments, the polishing liquid dispenser 130 includes a plurality of liquid channels communicated with each other (as FIG. 5 shows). With the polishing liquid dispenser 130 including the plurality of liquid channels to apply polishing liquid, the polishing head 220 can polish the wafer W with sufficient polishing liquid. Moreover, with the polishing liquid dispenser 130 embedded in the polishing head 220, the polishing head 220 can rotate with the polishing liquid dispenser 130, so that the polishing liquid can be uniformly spread onto the wafer W when the polishing head 220 polishes the wafer W.

As used therein, the term "die size polishing pad" refers to a polishing pad that has a polishing surface whose area is substantially the same as that of a die on the wafer. For example, the bottom surface of the die size polishing pad 221 has an area substantially the same as that of a die on the wafer W.

In some embodiments, the die size polishing pad 221 may be a polishing pad with or without abrasive. The abrasive can be made of silica, alumina, ceria, SiC, or diamond. Silica, alumina, or ceria based slurry can be used on the die size polishing pad 221 without abrasive. The diameter of the die size polishing pad 221 is in a range from about 1 mm to about 100 mm.

Figure 8:
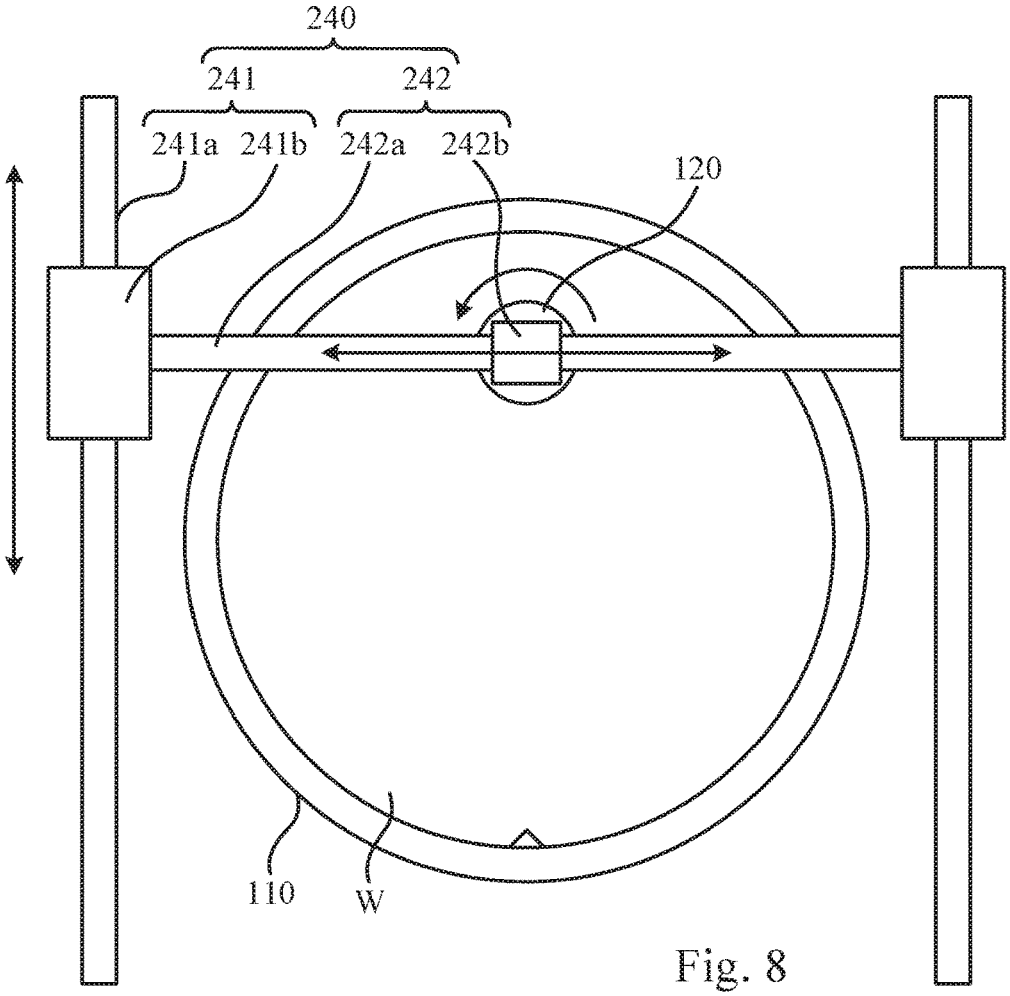
FIG. 8 is a top view of a die size polisher according to some embodiments of the present disclosure.

Reference is made to FIG. 8. FIG. 8 is a top view of a die size polisher 100 according to some embodiments of the present disclosure. As shown in FIG. 8, a movement mechanism 240 includes a first linear movement module 241 and a second linear movement module 242. The first linear movement module 241 includes two first rails 241*a* and two first moving blocks 241*b*. For simplicity, only one first rail 241*a* and one first moving block 241*b* are labeled. The first rails 241*a* are parallel to each other. Each of the first moving blocks 241*b* is configured to move along the corresponding first rail 241*a*. The second linear movement module 242 includes a second rail 242*a* and a second moving block 242*b*. Two ends of the second rail 242*a* are respectively connected to the first moving blocks 241*b*, and the second moving block 242*b* is configured to move along the second rail 242*a*, so that the second linear movement module 242 can move along the first rails 241*a* through the first moving blocks 241*b*. The second rail 242*a* is not parallel to the first rails 241*a*. In some embodiments, the second rail 242*a* is perpendicular to the first rails 241*a*, but the disclosure is not limited in this regard. The polishing head 120 is rotatably disposed under the second moving block 142*b* through the rotation mechanism 150 (referring to the structural connection between the moving block 142*b* and the rotation mechanism 150 shown in FIG. 1). Under the structural configuration, the movement mechanism 240 can move the polishing head 120 to align the polishing surface 121*a* with any position on the wafer W by using the first linear movement module 241 and the second linear movement module 242. That is, the movement mechanism 240 shown in FIG. 8 is configured to move the polishing head 120 relative to the wafer carrier 110 in two dimensions, and the dimensions are substantially linearly independent. By moving the polishing head 120 across the wafer W along a specific scan line with a specific line scan speeds (i.e., dwell time), a specific removal amount can be performed at specific surface area (corresponding to the specific scan line) of the wafer W.

Figure 9:
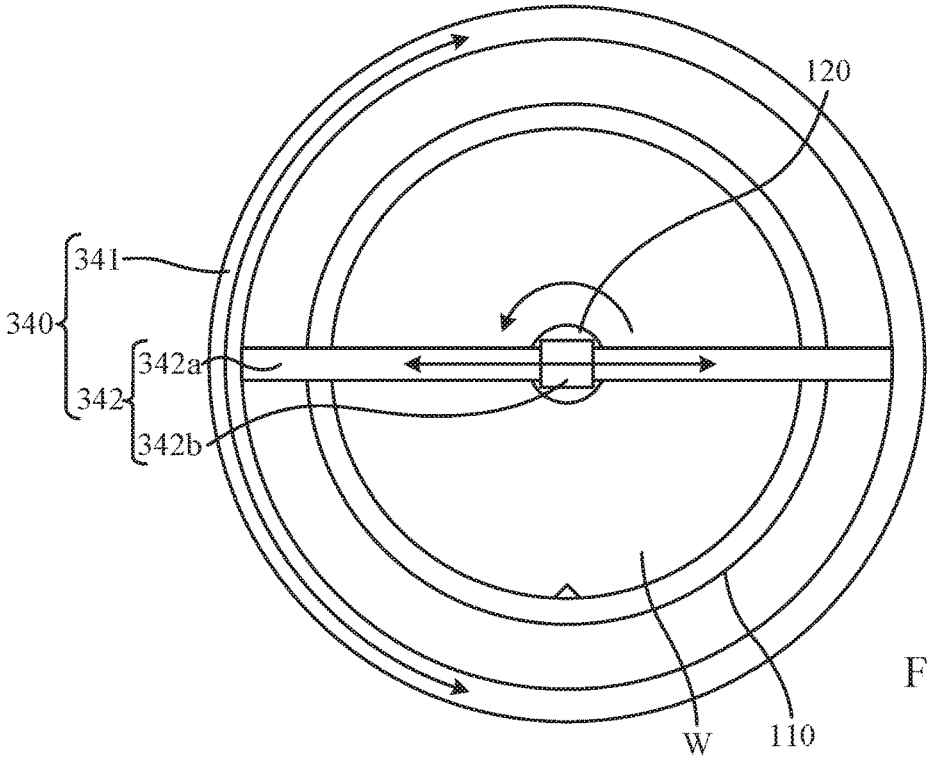
FIG. 9 is a top view of a die size polisher according to some embodiments of the present disclosure.

Reference is made to FIG. 9. FIG. 9 is a top view of a die size polisher 100 according to some embodiments of the present disclosure. As shown in FIG. 9, a movement mechanism 340 includes a rotation module 341 and a linear movement module 342. Specifically, the rotation module 341 is in form of a circle rail and substantially surrounds the peripheral edge of the wafer W. The linear movement module 342 includes a rail 342*a* and a moving block 342*b*. Two ends of the rail 342*a* are connected to the rotation module 341, so that the linear movement module 342 can rotate relative to the rotation module 341. The rotational axis of the rail 342*a* is substantially aligned with the center of the wafer W. The moving block 342*b* is configured to move along the rail 342*a*, and the polishing head 120 is rotatably disposed under the moving block 342*b* through the rotation mechanism 150 (referring to the structural connection between the moving block 142*b* and the rotation mechanism 150 shown in FIG. 1). Under the structural configuration, the movement mechanism 340 can move the polishing head 120 to align the polishing surface 121*a* with any position on the wafer W by using the rotation module 341 and the linear movement module 342. Specifically, any position on the wafer W can be defined by different radius distance d and angle θ. For example, a coordinate (X, Y) on the wafer W can be calculated by the formula: (d*cos θ, d*sin θ). By moving the polishing head 120 at a specific position on the wafer W with a specific dwell time, a specific removal amount can be performed at specific surface area (corresponding to the specific position) of the wafer W. Specifically, the removal amount at a specific position can be calculated by the following equation:

$$\text{Removal amount (A)} = \text{dwell time (sec)} * \text{polish rate (A/sec)} \quad (1)$$

Figure 10:
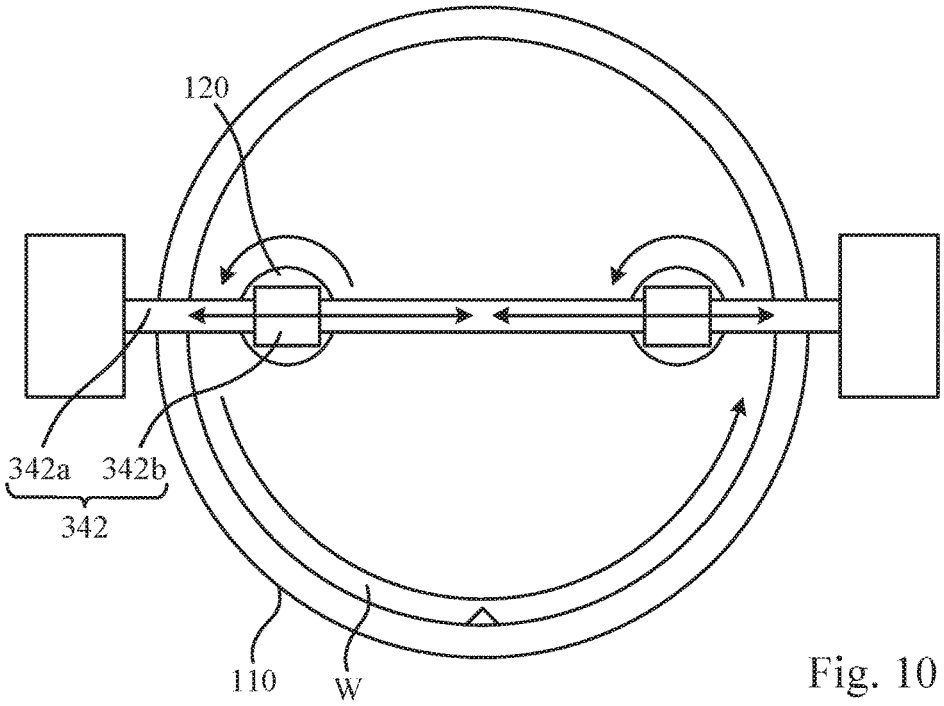
FIG. 10 is a top view of a die size polisher according to some embodiments of the present disclosure.

Reference is made to FIG. 10. FIG. 10 is a top view of a die size polisher 100 according to some embodiments of the present disclosure. As shown in FIG. 10, a movement mechanism including the rotation module 141 (disposed under the wafer carrier 110 without shown in FIG. 10, but can be referred to FIG. 1) and the linear movement module 342 shown in FIG. 9 without the rotation module 341 can be used. Specifically, in the embodiment, the linear movement module 342 in FIG. 10 includes the rail 342*a* that is stationary and two moving blocks 342*b* that are configured to move along the rail 342*a*, and two polishing heads 120 each is rotatably disposed under the corresponding moving block 342*b* through the rotation mechanism 150 (referring to the structural connection between the moving block 142*b* and the rotation mechanism 150 shown in FIG. 1). The rail 342*a* is substantially across over the center of the wafer W. Under the structural configuration, the movement mechanism 340 in FIG. 10 can move polishing heads 120 to align the polishing surfaces 121*a* with any position on the wafer W by using the rotation module 141 and the linear movement module 342.

Figure 11:
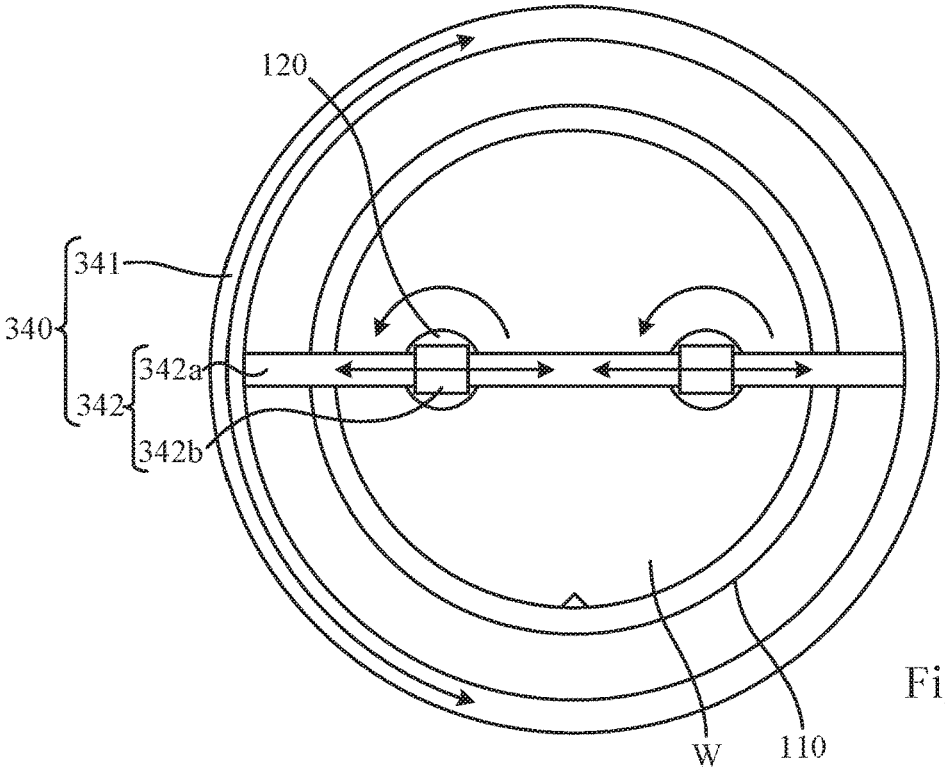
FIG. 11 is a top view of a die size polisher according to some embodiments of the present disclosure.

Reference is made to FIG. 11. FIG. 11 is a top view of a die size polisher 100 according to some embodiments of the present disclosure. As shown in FIG. 11, the movement mechanism 340 shown in FIG. 9 can be used. Specifically, in the embodiment, the linear movement module 342 of the movement mechanism 340 includes two moving blocks 342*b* that are configured to move along the rail 342*a*, and two polishing heads 120 each is rotatably disposed under the corresponding moving block 342*b* through the rotation mechanism 150 (referring to the structural connection between the moving block 142*b* and the rotation mechanism 150 shown in FIG. 1). Under the structural configuration, the movement mechanism 340 in FIG. 11 can move polishing heads 120 to align the polishing surfaces 121*a* with any position on the wafer W by using the rotation module 341 and the linear movement module 342.

Figure 12:
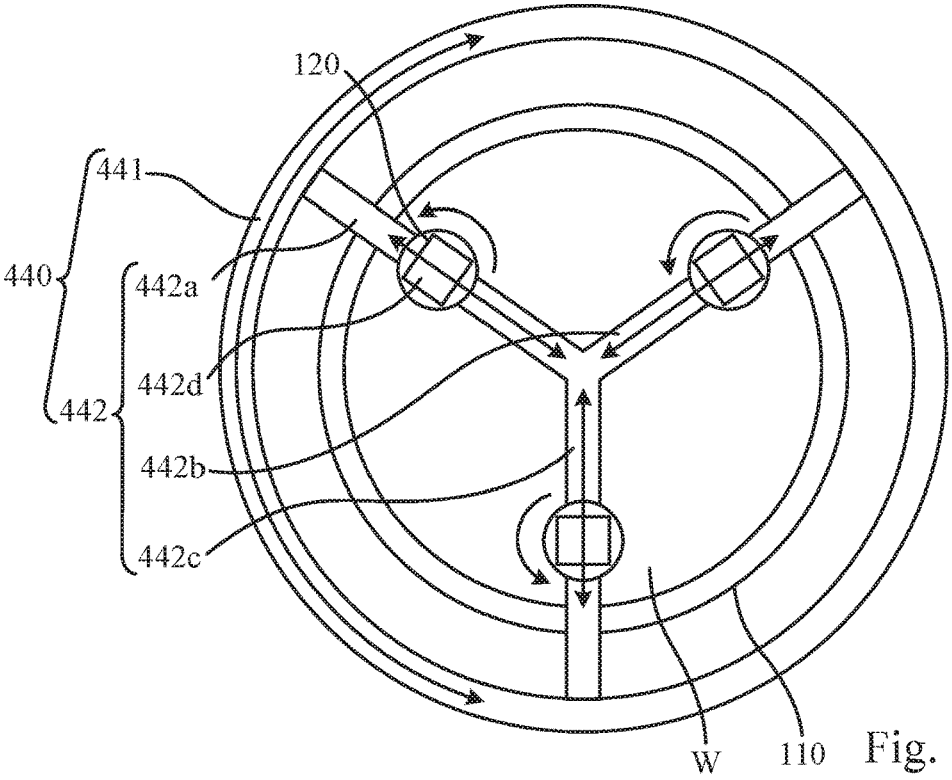
FIG. 12 is a top view of a die size polisher according to some embodiments of the present disclosure.

Reference is made to FIG. 12. FIG. 12 is a top view of a die size polisher 100 according to some embodiments of the present disclosure. As shown in FIG. 12, a movement mechanism 440 includes a rotation module 441 and a linear movement module 442. Specifically, the rotation module 441 is in form of a circle rail and substantially surrounds the peripheral edge of the wafer W. The linear movement module 442 includes a first rail 442*a*, a second rail 442*b*, a third rail 442*c*, and three moving blocks 442*d*. For simplicity, only one moving block 442*d* is labeled. An end of the first rail 442*a*, an end of the second rail 442*b*, and an end of the third rail 442*c* are connected to each other, and another end of the first rail 442*a*, another end of the second rail 442*b*, and another end of the third rail 442*c* are connected to the rotation module 441, so that the linear movement module 442 can rotate relative to the rotation module 441. The rotational axis of a combination of the first rail 442*a*, the second rail 442*b*, and the third rail 442*c* is substantially at the ends of the first rail 442*a*, the second rail 442*b*, and the third rail 442*c* that are connected to each other and aligned with the center of the wafer W. The moving blocks 442*d* are configured to respectively move along the first rail 442*a*, the second rail 442*b*, and the third rail 442*c*, and each of three polishing heads 120 is rotatably disposed under the corresponding moving block 442*d* through the corresponding rotation mechanism 150 (referring to the structural connection between the moving block 142*b* and the rotation mechanism 150 shown in FIG. 1). Under the structural configuration, the movement mechanism 440 can move polishing heads 120 to align the polishing surfaces 121*a* with any position on the wafer W by using the rotation module 441 and the linear movement module 442.

Figure 13A:
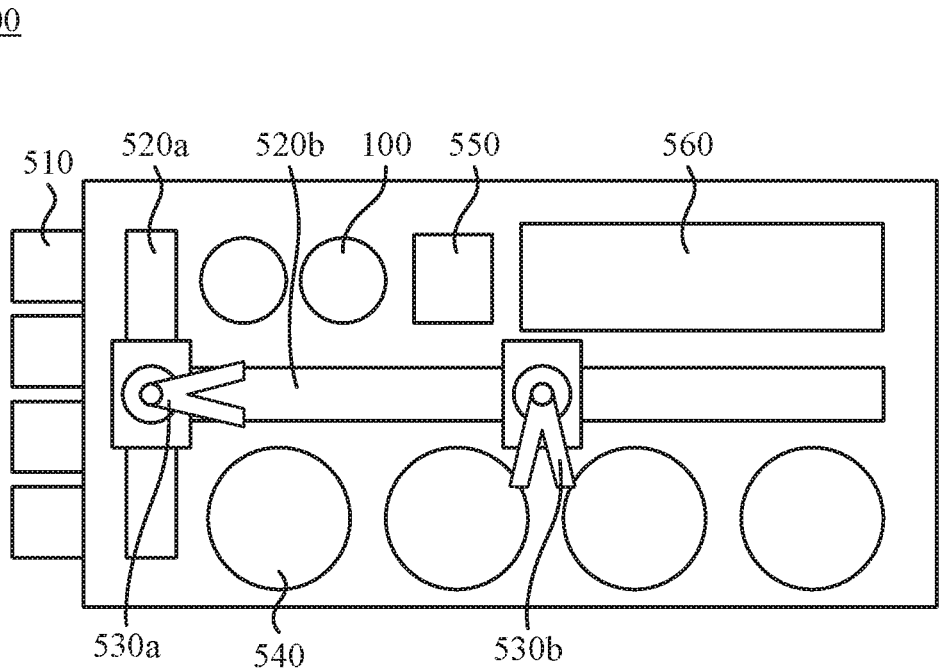
FIG. 13A is a schematic diagram of a polishing tool according to some embodiments of the present disclosure.
Figure 13B:
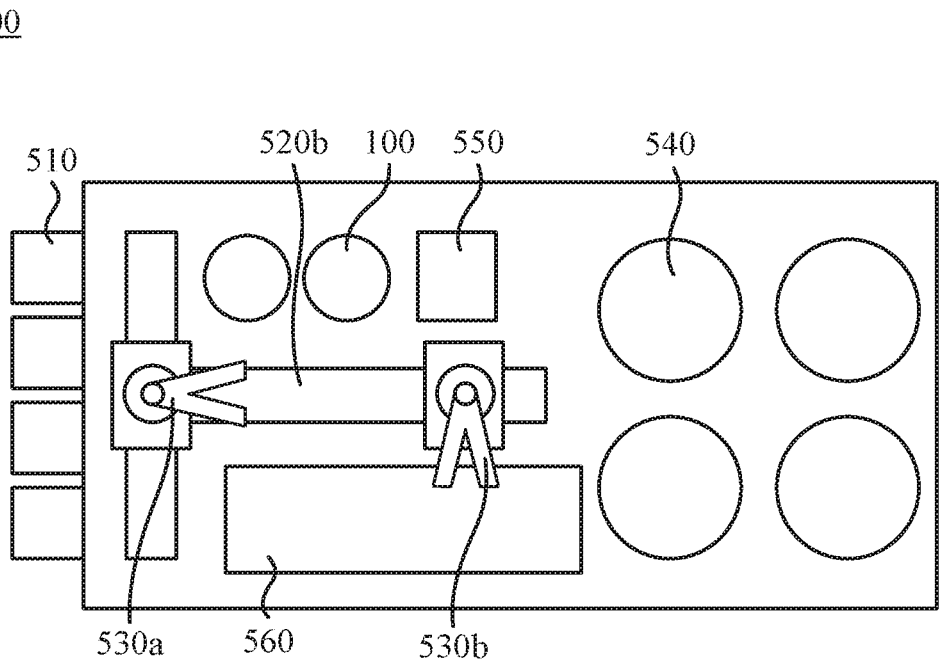
FIG. 13B is a schematic diagram of the polishing tool of FIG. 13A with a different arrangement according to some other embodiments of the present disclosure.

Reference is made to FIGS. 13A and 13B. FIG. 13A is a schematic diagram of a polishing tool 500 according to some embodiments of the present disclosure. FIG. 13B is a schematic diagram of the polishing tool 500 of FIG. 13A with a different arrangement according to some other embodiments of the present disclosure. As shown in FIGS. 13A and 13B, a polishing tool 500 includes a plurality of load/unload modules 510, a first robot rail 520*a*, a second robot rail 520*b*, a first wafer robot 530*a*, a second wafer robot 530*b*, a plurality of main polishers 540, a plurality of the die size polishers 100 (referring to FIG. 1), a metrology tool 550, and a post CMP clean module 560. For simplicity, only one load/unload module 510, one main polisher 540, and one die size polisher 100 are labeled. The load/unload modules 510 are configured to load/unload cassettes (not shown). The first robot rail 520*a* is disposed adjacent to the load/unload modules 510. The first wafer robot 530*a* can move to any one of the load/unload modules 510 along the first robot rail 520*a*. The first wafer robot 530*a* is configured to load/unload the wafers W in the cassettes at the load/unload modules 510. The second robot rail 520*b* is disposed adjacent to the first robot rail 520*a*, the main polishers 540, the die size polishers 100, the metrology tool 550, and the post CMP clean module 560. The second wafer robot 530*b* can move to the first robot rail 520*a*, the main polishers 540, the die size polishers 100, the metrology tool 550, or the post CMP clean module 560 along the second robot rail 520*b*. The second wafer robot 530*b* is configured to transfer the wafer W from the first wafer robot 530*a* to one of the main polishers 540, one of the die size polishers 100, the metrology tool 550, or the post CMP clean module 560, or conversely. For example, in a processing scenario, the first wafer robot 530*a* can pick up a wafer W in a cassette at one of the load/unload modules 510, and then the second wafer robot 530*b* transfers the wafer W from the first wafer robot 530*a* to one of the main polishers 540 for coarse polishing. Each of the main polishers 540 is consist of a rotating and extremely flat platen which is covered by a pad. The wafer W that is being polished is held upside-down in a carrier/spindle on a backing film. The retaining ring keeps the wafer W in the correct horizontal position. A slurry introduction mechanism deposits the slurry on the pad. Both the platen and the carrier are then rotated and the carrier is kept oscillating. A downward pressure/down force is applied to the carrier, pushing it against the pad. Generally, the pad is made from porous polymeric materials with a pore size between 30-50 μm, and because the pad is consumed in the process, it needs to be regularly reconditioned. In some embodiments, the main polishers 540 of FIGS. 13A and 13B include two main polish platens and two buff polish platens, but the disclosure is not limited in this regard.

After the main polisher 540 polishes the wafer W, the second wafer robot 530*b* transfers the wafer W to the metrology tool 550 to measure and determine whether the wafer W is out of thickness specifications. Specifically, the metrology tool 550 is configured to measure and determine whether the WiW (Within wafer) thickness range of the wafer W is out of the thickness specifications. If the WiW thickness range of the wafer W is out of the thickness specifications, the second wafer robot 530*b* transfers the wafer W from the metrology tool 550 to one of the die size polishers 100 for fine polishing. If the WiW thickness range of the wafer W is in the thickness specifications, the second wafer robot 530*b* transfers the wafer W from the metrology tool 550 to the post CMP clean module 560 for further cleaning the polished wafer W. It should be pointed out that the numbers of the load/unload modules 510, the first robot rail 520*a*, the second robot rail 520*b*, the first wafer robot 530*a*, the second wafer robot 530*b*, the main polishers 540, the die size polishers 100, the metrology tool 550, and the post CMP clean module 560 are not limited by FIGS. 13A and 13B.

Figure 14A:
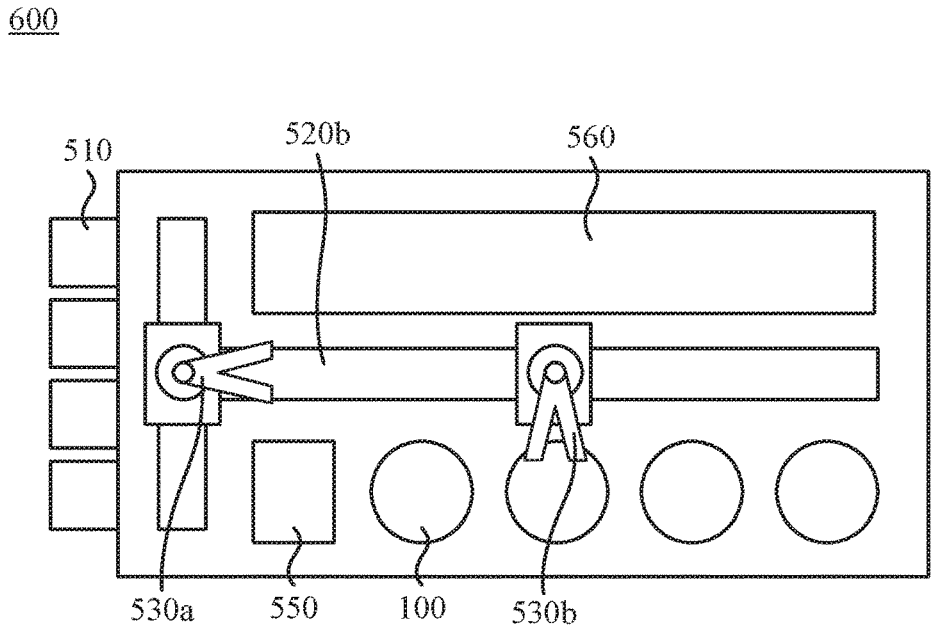
FIG. 14A is a schematic diagram of a polishing tool according to some embodiments of the present disclosure.

Reference is made to FIG. 14A. FIG. 14A is a schematic diagram of a polishing tool 600 according to some embodiments of the present disclosure. As shown in FIG. 14A, a polishing tool 600 includes a plurality of the load/unload modules 510, the first robot rail 520*a*, the second robot rail 520*b*, the first wafer robot 530*a*, the second wafer robot 530*b*, the plurality of the die size polishers 100 (referring to FIG. 1), the metrology tool 550, and the post CMP clean module 560. For simplicity, only one load/unload module 510 and one die size polisher 100 are labeled. Compared with the polishing tool 500 of FIG. 13A, the polishing tool 600 of FIG. 14A does not include any main polisher 540. For example, in a processing scenario, the first wafer robot 530*a* can pick up a wafer W in a cassette at one of the load/unload modules 510, and then the second wafer robot 530*b* transfers the wafer W from the first wafer robot 530*a* to one of the die size polishers 100 for polishing. After the die size polisher 100 polishes the wafer W, the second wafer robot 530*b* transfers the wafer W to the metrology tool 550 to measure and determine whether the wafer W is out of the thickness specifications. Specifically, the metrology tool 550 is configured to measure and determine whether the WiW (Within wafer) thickness range of the wafer W is out of the thickness specifications. If the WiW thickness range of the wafer W is out of the thickness specifications, the second wafer robot 530*b* transfers the wafer W from the metrology tool 550 to one of the die size polishers 100 for fine polishing again. If the WiW thickness range of the wafer W is in the thickness specifications, the second wafer robot 530*b* transfers the wafer W from the metrology tool 550 to the post CMP clean module 560 for further cleaning the polished wafer W. In other words, the die size polishers 100 in FIG. 14A fully replace the main polishers 540 in FIGS. 13A and 13B to do all polishing processes. It should be pointed out that the numbers of the load/unload modules 510, the first robot rail 520*a*, the second robot rail 520*b*, the first wafer robot 530*a*, the second wafer robot 530*b*, the die size polishers 100, the metrology tool 550, and the post CMP clean module 560 are not limited by FIG. 14A.

Figure 14B:
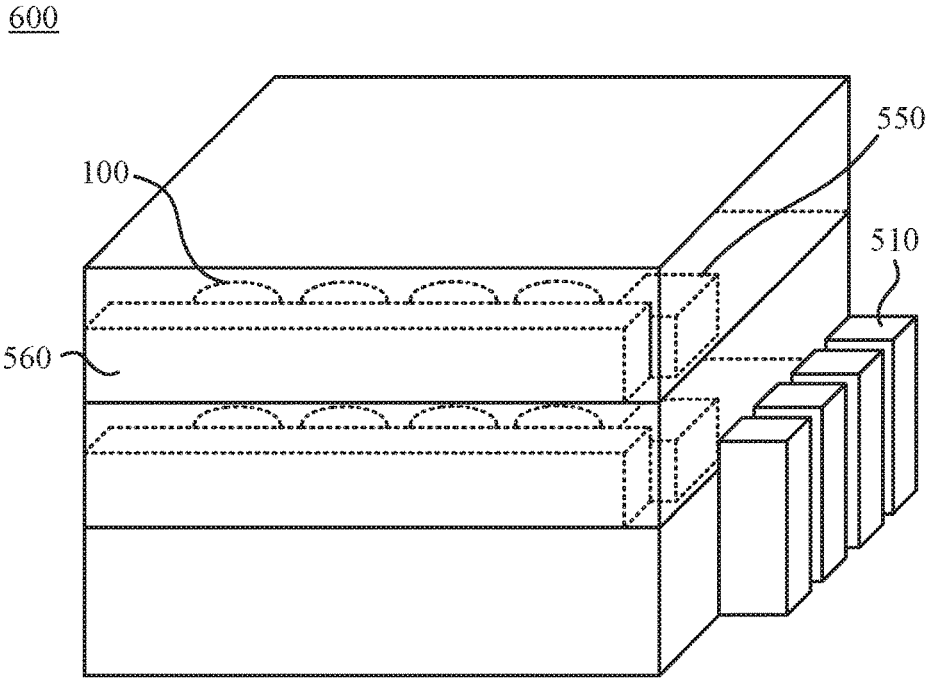
FIG. 14B is a schematic diagram of the polishing tool of FIG. 14A according to some other embodiments of the present disclosure.

Reference is made to FIG. 14B. FIG. 14B is a schematic diagram of the polishing tool 600 of FIG. 14A according to some other embodiments of the present disclosure. The polishing tool 600 has a "multi-decker" tool configuration. That is, as shown in FIG. 14B, the polishing tool 600 includes eight die size polishers 100, two metrology tools 550, and two post CMP clean modules 560. At a result, the polishing tool 600 having the "multi-decker" tool configuration can provide high throughput.

Figure 15:
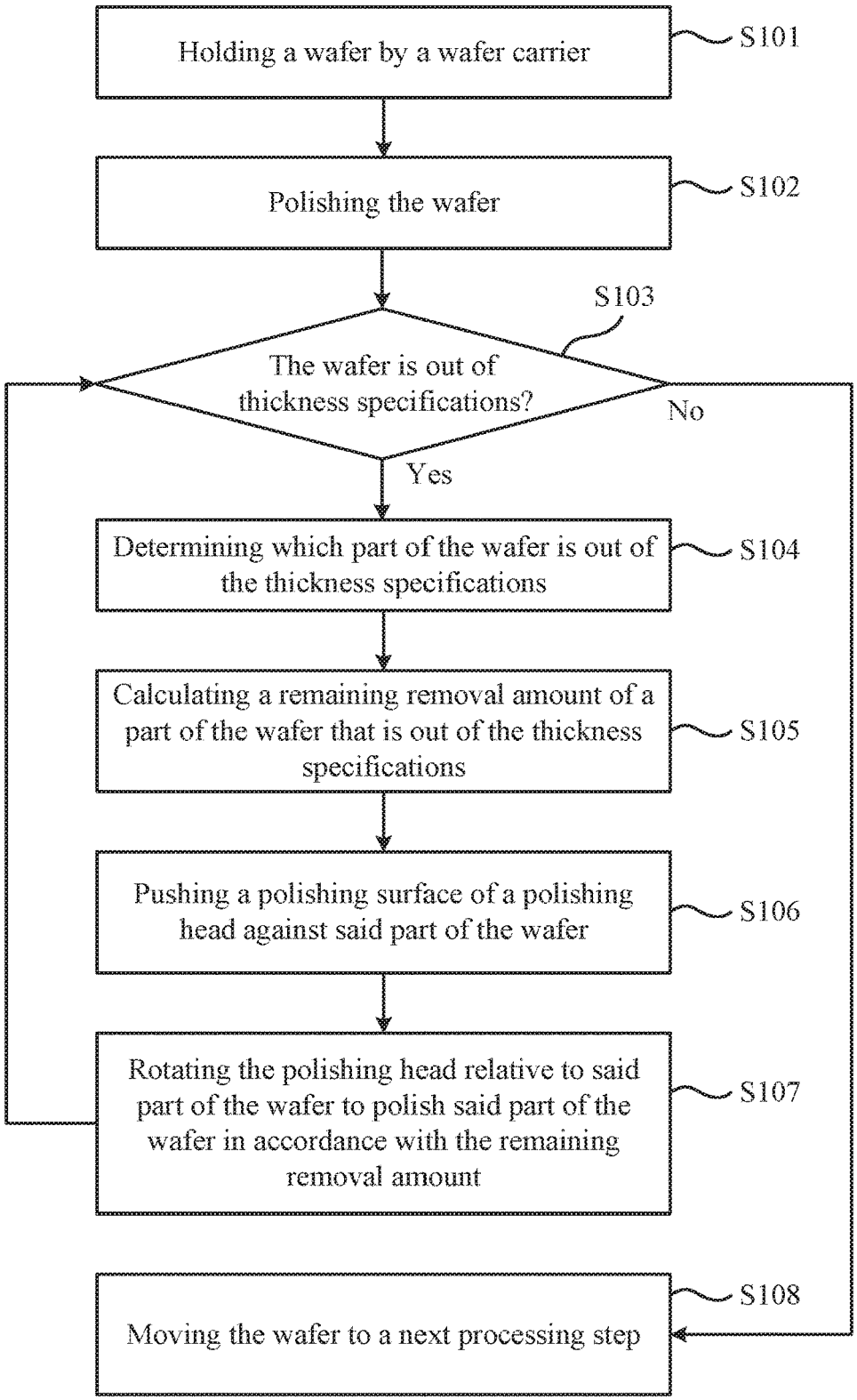
FIG. 15 is a flowchart of a polishing method according to some embodiments of the present disclosure.

Reference is made to FIG. 15. FIG. 15 is a flowchart of a polishing method according to some embodiments of the present disclosure. The method begins with block operation S101 in which a wafer carrier holds a wafer. The method continues with operation S102 in which the wafer is polished. In some embodiments, the operation S102 can be performed by using the main polishers 540 or the die size polishers 100 in FIGS. 13A and 13B. The method continues with operation S103 in which whether the wafer is out of thickness specifications is determined. Specifically, in operation S103, whether the WiW (Within wafer) thickness range of the wafer is out of the thickness specifications is determined. The method continues with operation S104 in which which part of the wafer is out of the thickness specifications is determined. The method continues with operation S105 in which a remaining removal amount of a part of the wafer that is out of the thickness specifications is calculated if the wafer is out of thickness specifications. The method continues with operation S106 in which a polishing surface of a polishing head pushes against said part of the wafer. The method continues with operation S107 in which the polishing head rotates relative to said part of the wafer to polish said part of the wafer in accordance with the remaining removal amount. In some embodiments, the operation S106-S107 can be performed by using the die size polishers 100 in FIGS. 13A and 13B. In some embodiments, the operation S107 continues with the operation S103, and the operations S104-S107 are repeated if the wafer is still out of the thickness specifications. In some embodiments, the wafer has a plurality of parts that are out of the thickness specifications, and each of said parts of the wafer can be individually polished in accordance with the operations S105-S107, till the wafer is in the thickness specifications. The method continues with operation S108 in which the wafer is moved to a next processing step if the wafer is in the thickness specifications. As a result, the wafer can implement IM-CLC (integrated metrology closed-loop-control) mode to do rework procedures of polishing in accordance with the polishing method of the present disclosure.

According to the foregoing recitations of the embodiments of the disclosure, it can be seen that the disclosure provides several die size polisher designs, several polishing tool designs using the die size polisher designs, and polishing methods to effectively improve the uniformity control capability of WiW (Within wafer) thickness range during CMP (Chemical Mechanical Polishing).

According to some embodiments, a polisher is provided. The polisher includes a wafer carrier, a polishing head, a movement mechanism, and a rotation mechanism. The wafer carrier has a supporting surface. The supporting surface is configured to carry a wafer thereon. The polishing head is present above the wafer carrier. The polishing head has a polishing surface. The polishing surface of the polishing head is smaller than the supporting surface of the wafer carrier. The movement mechanism is configured to move the polishing head relative to the wafer carrier. The rotation mechanism is configured to rotate the polishing head relative to the wafer carrier.

According to some embodiments, a polishing tool is provided. The polishing tool includes a main polisher, a die size polisher, and a wafer robot. The main polisher is configured to polish a wafer. The die size polisher has a die size polishing pad. The die size polishing pad is configured to polish the wafer. The wafer robot is configured to move the wafer between the main polisher and the die size polisher.

According to some embodiments, a polishing method is provided. The polishing method includes: holding a wafer by a wafer carrier; pushing a polishing surface of the polishing head against a part of the wafer; and rotating the polishing head relative to said part of the wafer to polish said part of the wafer.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A polisher comprising:

a wafer carrier having a supporting surface configured to carry a wafer thereon;

a polishing head present above the wafer carrier, the polishing head having a polishing surface, wherein the polishing surface of the polishing head is smaller than the supporting surface of the wafer carrier;

a movement mechanism including a rail and configured to move the polishing head along the rail relative to the wafer carrier and further configured to rotate the rail about a center of the wafer carrier; and a rotation mechanism configured to rotate the polishing head relative to the wafer carrier.

2. The polisher of claim 1, wherein the polishing surface of the polishing head has an area substantially the same as that of a die on the wafer.

3. The polisher of claim 1, wherein the polishing head comprises:

at least one polishing pad tape;

at least one tape tension pulley assembly configured to carry the polishing pad tape; and at least one pushing head configured to push at least a part of the polishing pad tape against the wafer.

4. The polisher of claim 1, wherein the polishing head comprises:

at least one polishing pad; and at least one carrier head configured to carry the polishing pad against the wafer.

5. The polisher of claim 1, further comprising:

a polishing liquid dispenser configured to dispense polishing liquid onto the wafer.

6. The polisher of claim 5, wherein the polishing liquid dispenser is present on the polishing head.

7. The polisher of claim 5, wherein the polishing liquid dispenser is present adjacent to the polishing head.

8. The polisher of claim 1, wherein the movement mechanism is configured to move the polishing head relative to the wafer carrier in at least two dimensions.

9. The polisher of claim 8, wherein the dimensions are substantially linearly independent.

10. The polisher of claim 1, wherein the movement mechanism comprising:

a rotation module configured to rotate the wafer carrier relative to the polishing head.

11. The polisher of claim 1, wherein the movement mechanism carries a plurality of the polishing heads.

12. A polishing tool, comprising:

a main polisher configured to polish a wafer;

a die size polisher having a die size polishing pad configured to polish the wafer; and a wafer robot configured to move the wafer between the main polisher and the die size polisher.

13. The polishing tool of claim 12, wherein the main polisher is larger than the die size polisher.

14. A polishing method, comprising:

holding a wafer by a wafer carrier;

polishing the wafer;

determining whether the wafer is out of thickness specifications after the polishing;

determining which part of the wafer is out of the thickness specifications after the polishing;

pushing a polishing surface of a polishing head against a part of the wafer which is out of thickness specifications; and rotating the polishing head relative to said part of the wafer to polish said part of the wafer.

15. The polishing method of claim 14, further comprising:

pushing the polishing surface of the polishing head against another part of the wafer; and rotating the polishing head relative to said another part of the wafer to polish said another part of the wafer.

16. The polishing method of claim 14, further comprising:

determining whether the wafer is out of the thickness specifications after the rotating; and repeating the pushing and the rotating till the wafer is in the thickness specifications.

17. The polishing method of claim 14, further comprising:

calculating a remaining removal amount of said part of the wafer, wherein the rotating is performed in accordance with the remaining removal amount.

18. The polisher of claim 1, wherein the movement mechanism further includes a second rail and is further configured to rotate the rail along the second rail.

19. The polisher of claim 1, further comprising a second polishing head, wherein the movement mechanism further includes a second rail and is further configured to move the second polishing head along the second rail and to rotate the second rail about the center of the wafer carrier, wherein ends of the rail and the second rail are connected to each other.

20. The polisher of claim 19, further comprising a third polishing head, wherein the movement mechanism further includes a third rail and is further configured to move the third polishing head along the third rail and to rotate the third rail about the center of the wafer carrier, wherein an end of the third rail is connected to the ends of the rail and the second rail.

* * * * *